United States Patent [19]

McKee

[11] 3,997,956

[45] Dec. 21, 1976

[54] WIRE INSERTION APPARATUS

[75] Inventor: William H. McKee, West Covina, Calif.

[73] Assignee: TRW Inc., Elk Grove Village, Ill.

[22] Filed: Aug. 30, 1974

[21] Appl. No.: 502,086

[52] U.S. Cl. ..... 29/203 MW; 29/203 DT; 29/203 HT

[51] Int. Cl.[2] ..... H01R 43/04

[58] Field of Search ..... 29/203 D, 203 DT, 203 H, 29/203 HT, 203 HC, 203 MW, 203 P, 628; 7/14.1 R

[56] References Cited

UNITED STATES PATENTS

| | | | |
|---|---|---|---|
| 3,168,750 | 2/1965 | Gattiker, Jr. | 7/14.1 R |
| 3,742,571 | 7/1973 | Brehm | 29/203 H |
| 3,800,390 | 4/1974 | Johnston | 29/203 P |
| 3,866,294 | 2/1975 | McCaughey | 29/203 H |

*Primary Examiner*—Carl E. Hall
*Attorney, Agent, or Firm*—Neuman, Williams, Anderson & Olson

[57] ABSTRACT

A tool having a ram with an advantageously formed insertion end portion is employed to force a wire laterally into a terminal of a connector. The wire is properly positioned with respect to the ram by means of guides included in the tool. The tool, with the wire, is properly positioned with respect to the terminal by cooperation with the connector and by a jig with means to hold the connector and ensure proper positioning of the ram end relative to the terminal. The wire is trimmed as it is moved into the terminal. During the insertion operation the wire is gripped by the tool to prevent axial movement of the wire relative to the tool and terminal.

33 Claims, 18 Drawing Figures

FIG. 2

FIG. 5
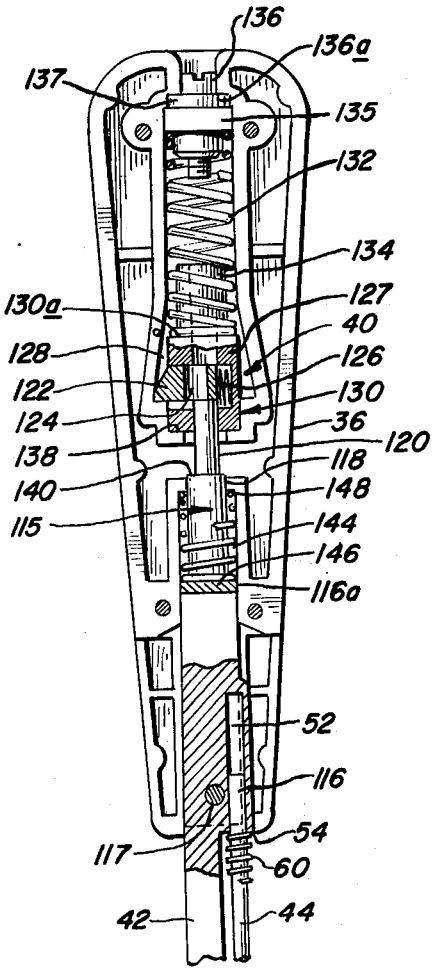
FIG. 5a
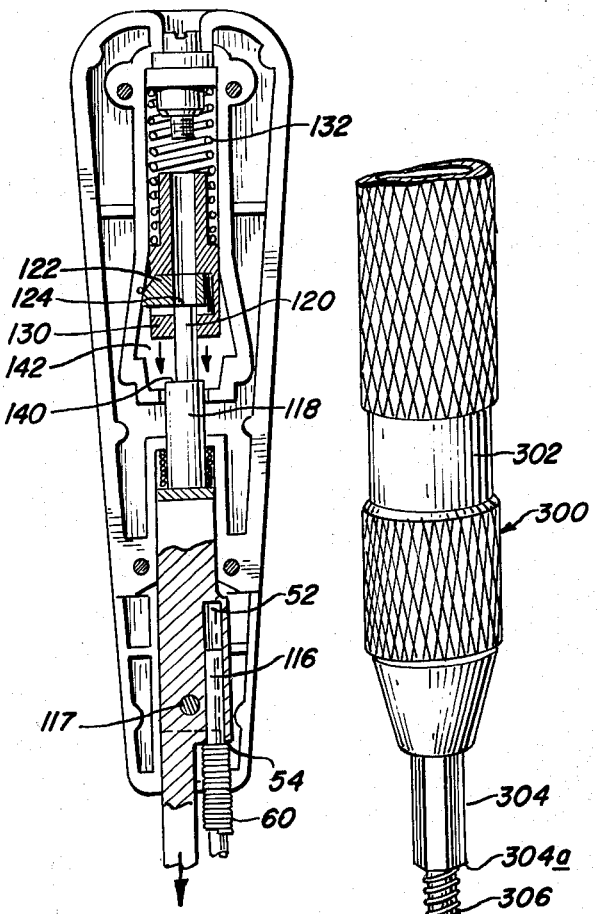
FIG. 10a
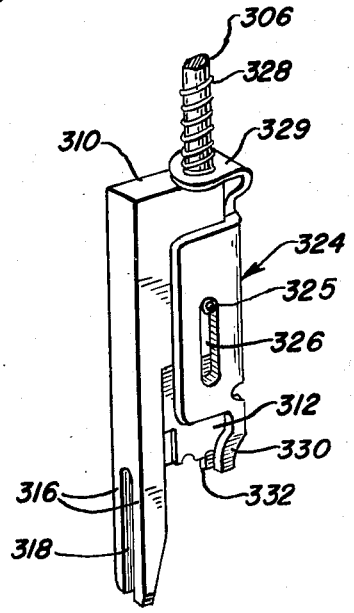
FIG. 10b

FIG. 6
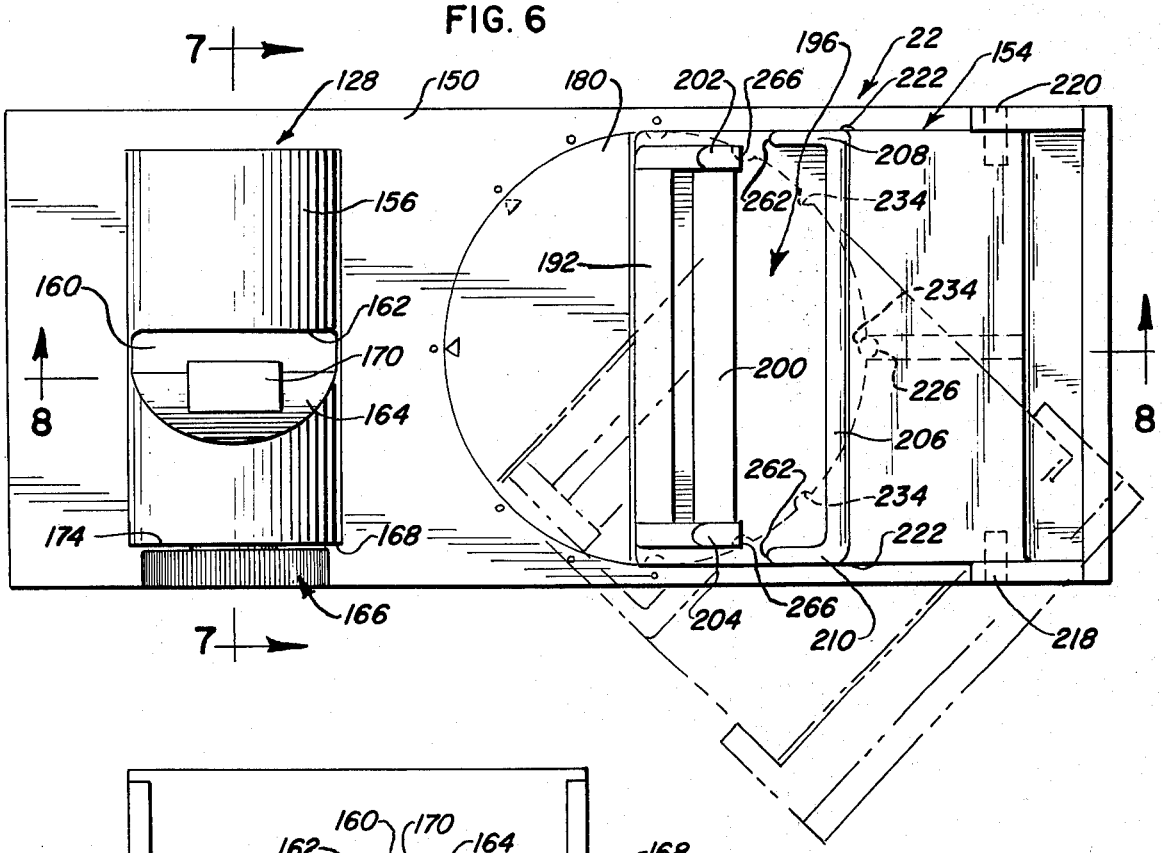
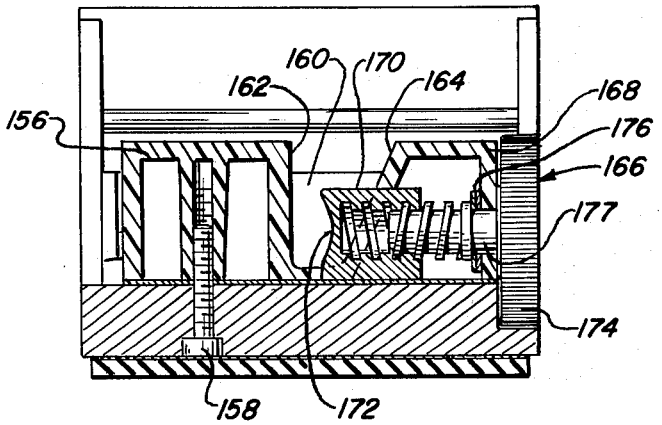
FIG. 7
FIG. 8
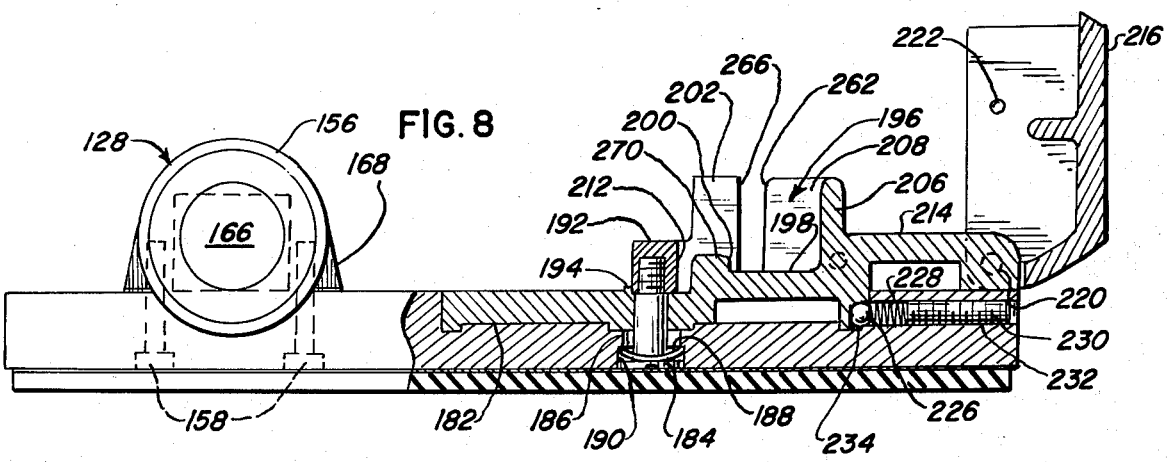

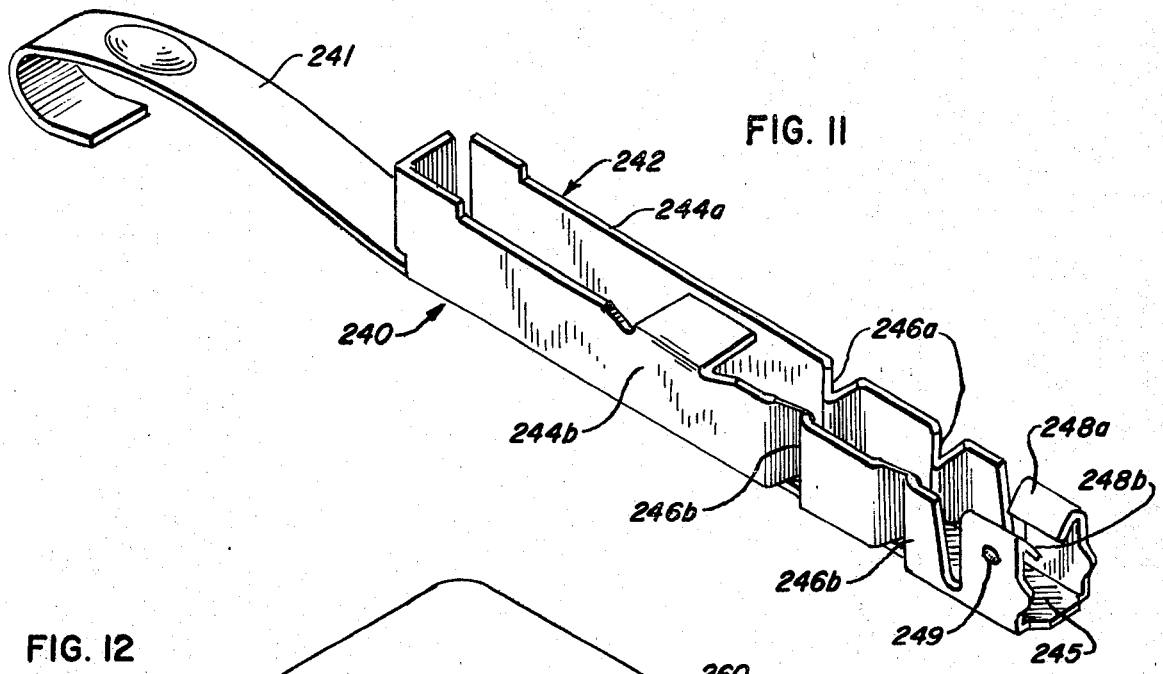
FIG. 11
FIG. 12
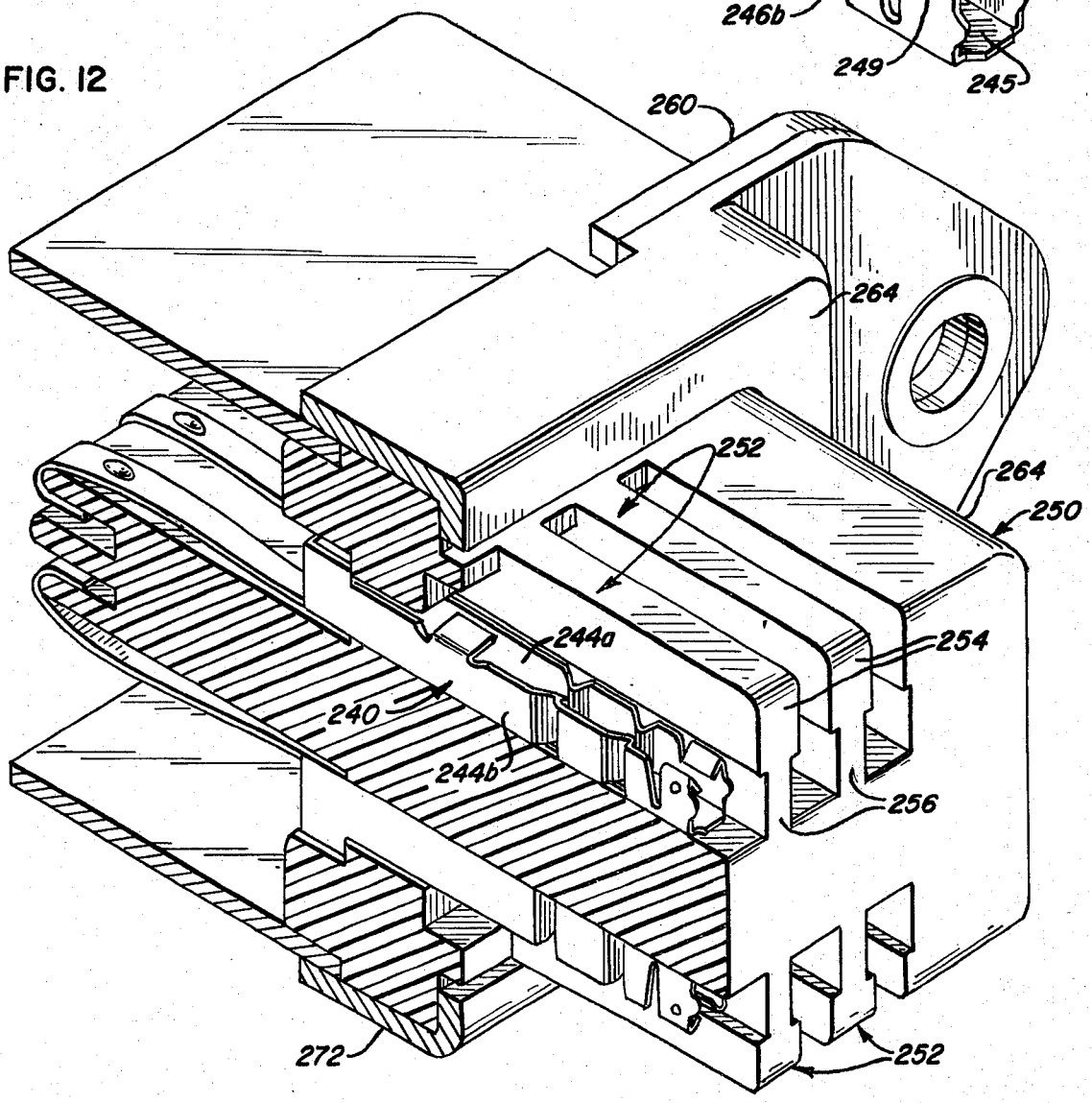

WIRE INSERTION APPARATUS

This invention relates to apparatus for terminating wires in a connector and, specifically, to apparatus to terminating wires in a solderless connector.

In recent years numerous forms of solderless connectors have been developed. In conjunction with the development of such connectors, various devices for inserting wires in such connectors have been produced. By way of example, various tools and devices for effecting terminations in solderless connectors are disclosed in Gattiker U.S. Pat. No. 3,168,750, Reem et al. U.S. Pat. No. 3,328,872, over U.S. Pat. No. 3,438,407, Dola et al. U.S. Pat. No. 3,594,900, Brown et al. U.S. Pat. No. 3,628,202, Mason U.S. Pat. No. 3,708,852, and Brehm U.S. Pat. No. 3,742,571.

Recent developments in the solderless connector art have included improved connectors employing an improved terminal such as illustrated in FIGS. 11 and 12 of the drawings herein and disclosed more fully in two co-pending applications, namely McKee application Ser. No. 443,730, filed Feb. 19, 1974, U.S. Pat. No. 3,902,154, and McKee and Witte application Ser. No. 443,678, filed Feb. 19, 1974.

It is an object of this invention to provide an improved wire insertion apparatus, and more particularly, to provide improved wire insertion apparatus which is suitable for use with connectors employing terminals of the type disclosed in the aforementioned applications. While the apparatus disclosed herein is adapted to such use, it is by no means limited to that use. Many applications of the invention disclosed herein, all equally within its spirit and scope, will become obvious to those skilled in the art. Similarly, further and additional objects and advantages will appear from the description, accompanying drawings and appended claims.

In an illustrative embodiment of my invention, a tool having a ram with an advantageously formed insertion end portion is employed to force a wire laterally into a terminal of a connector. The wire is properly positioned with respect to the ram by means of guides included in the tool. The tool, with the wire, is properly positioned with respect to the terminal by cooperation with the connector and by a jig with means to hold the connector and ensure proper positioning of the ram end relative to the terminal. The wire is trimmed as it is moved into the terminal. During the insertion operation the wire is gripped by the tool to prevent axial movement of the wire relative to the tool and terminal.

For a more complete understanding of this invention reference should now be had to the embodiments illustrated in greater detail in the accompanying drawings and described below by way of examples of the invention.

Figure 1:
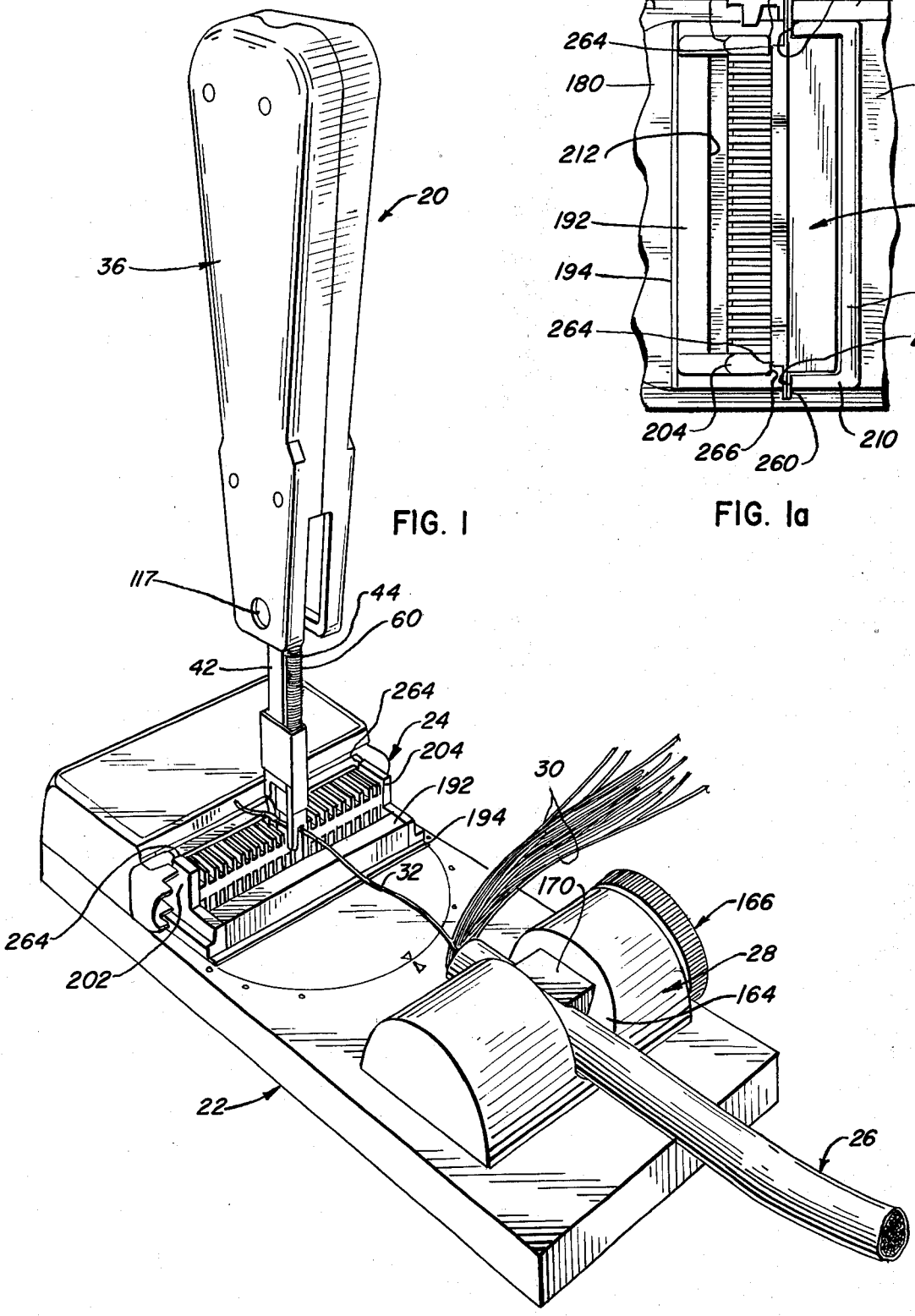
Figure 1A:
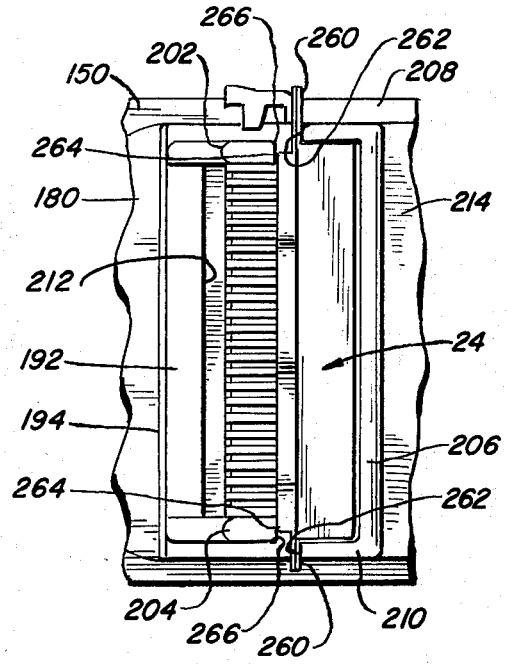
Figure 2:
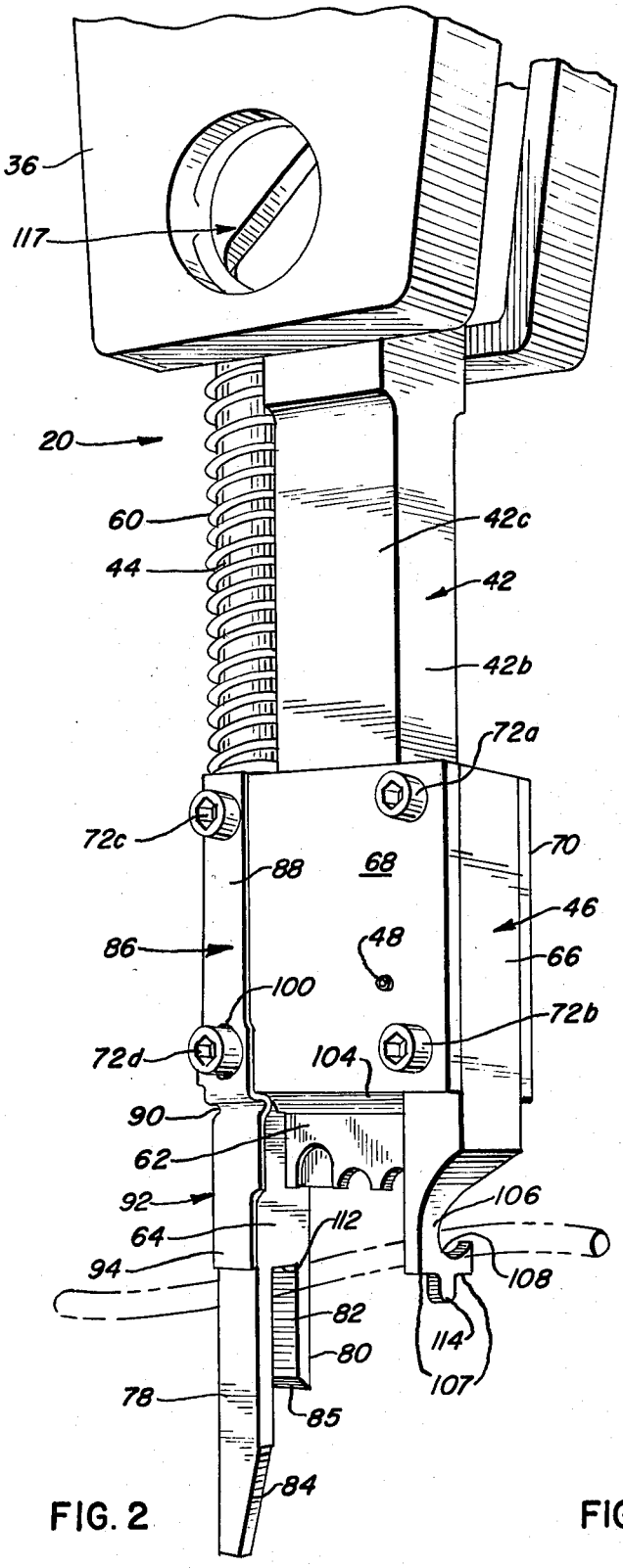
Figure 3:
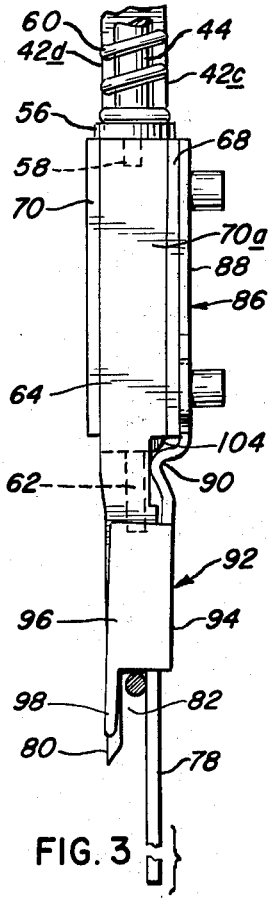
Figure 3A:
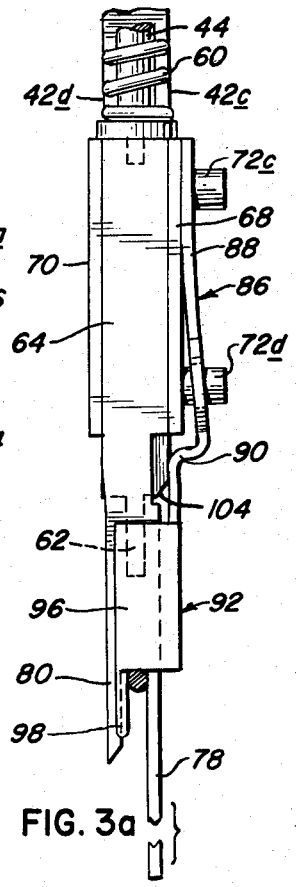
Figure 4:
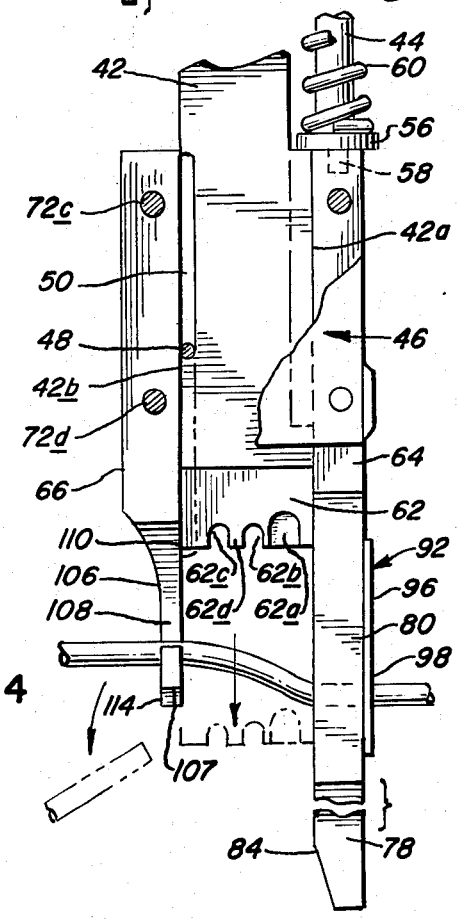

In the drawings, FIG. 1 is an illustrative embodiment of the invention including amounting jig holding a connector, and a cooperating hand tool;

FIG. 1*a* is a partial plan view of the connector and related portions of the jig of FIG. 1;

FIG. 2 is an enlarged oblique view of a portion of the hand tool shown in FIG. 1;

FIG. 3 and 3*a* are rear views of a portion of the hand tool shown in FIG. 1 in two position of operation;

FIG. 4 is a side view, partially broken away, of a portion of the hand tool shown in FIG. 1 illustrating two positions of operation;

FIGS. 5 and 5*a* are sectional views of the handle portion of the hand tool shown in FIG. 1, taken generally along line 5—5 of FIG. 1 and showing two positions of operation;

FIG. 6 is a plan view of the jig shown in FIG. 1 with an alternate position of the connector carriage shown in dashed lines;

FIGS. 7 and 8 are two sectional views of the jig shown in FIG. 6, taken generally along lines 7—7 and 8—8 of FIG. 6, respectively.

Figure 9A:
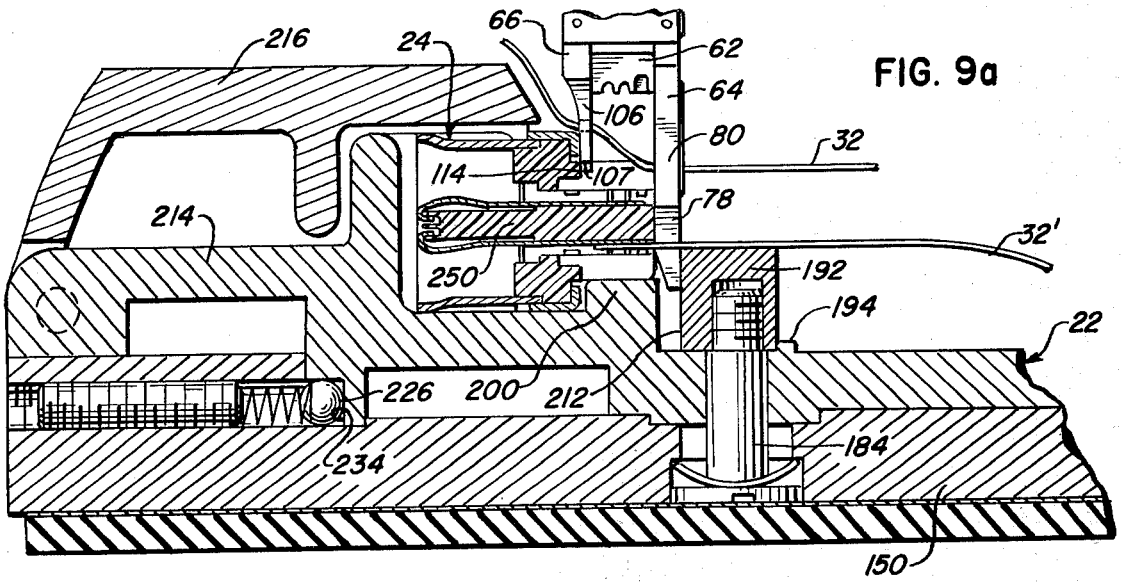
Figure 9B:
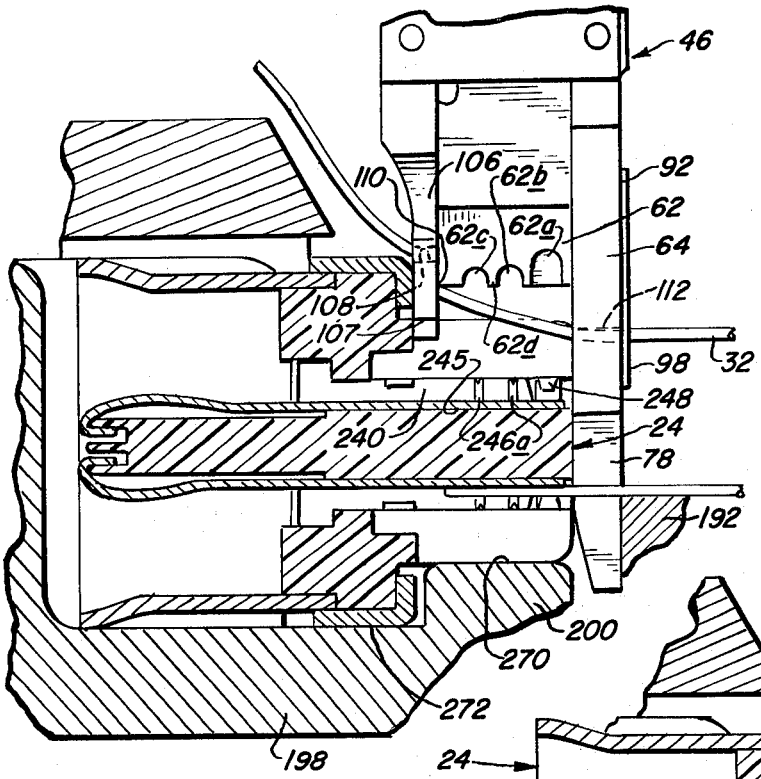
Figure 9C:
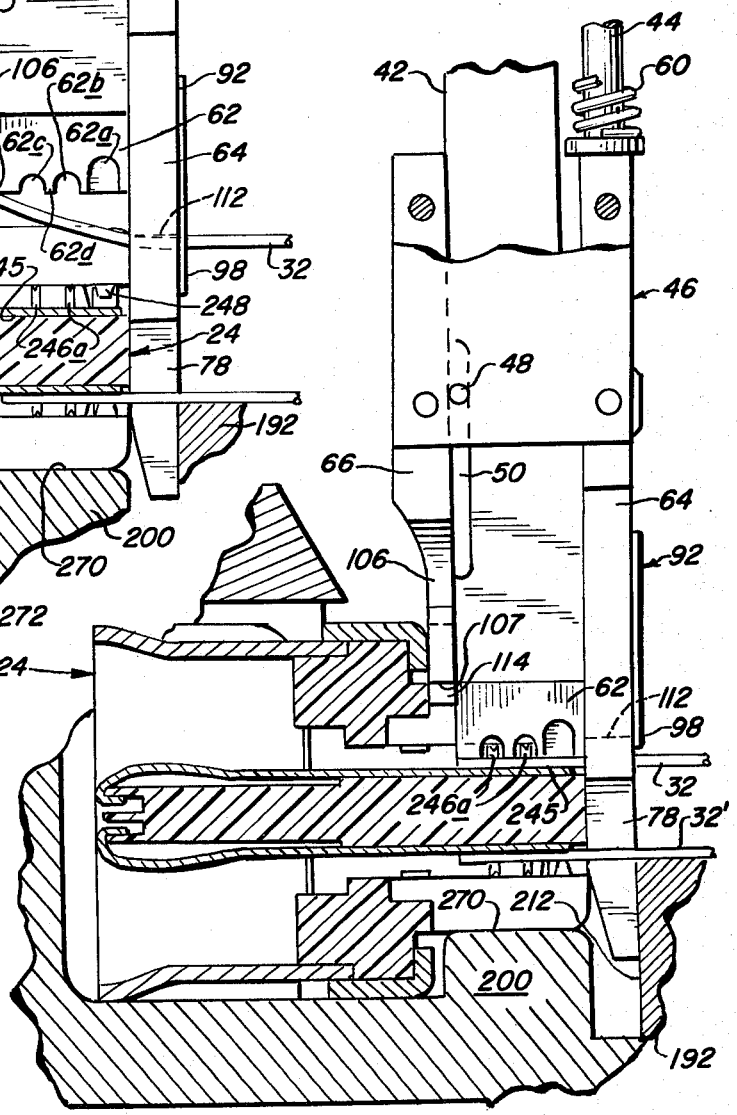

FIGS. 9*a*, 9*b* and 9*c* are enlarged sectional views showing the apparatus of FIG. 1 in various positions of operation while inserting a wire into a terminal;

FIGS. 10*a* and 10*b* are oblique views of an alternative tool for use in conjunction with the jig shown in FIG. 1;

FIG. 11 is an enlarged oblique view of a terminal of the type shown in part in FIGS. 9*a*–9*c*; and FIG. 12 is an enlarged partial view of a multiterminal connector including a plurality of the terminals shown in FIG. 11.

Referring now to the drawings, FIG. 1 illustrates a hand tool 20 as used in cooperation with a mounting jig 22 for inserting individual wires into preselected individual solderless terminals in a connector 24 which is held in the jig 22. A cable indicated at 26 is held in the jig 22 by a clamping assembly at 28. The cable 26 includes a plurality of wires 30, at least one of which, wire 32, is to be inserted in a selected terminal of the connector by the tool 20. As will be described in more detail below, alignment of the tool 20 with respect to a specific terminal of the connector 26 is assured by components of the tool which cooperate with the connector and with a part of the jig. Upon suitable operation of the tool, the wire 32 is trimmed to the appropriate length by clipping the excess from its distal end and the wire is inserted into the selected terminal of the connector.

Referring now also to FIGS. 2–5*a*, the tool 20 includes a handle 36 which houses an impact mechanism 40 to be described further below with particular reference to FIGS. 5 and 5*a*. A ram 42 and a parallel guide rod 44 project forwardly from the impact mechanism and handle, generally axially of the handle. A frame assemby 46 is slidably mounted on the ram 42 for relative reciprocating movement along the ram within the ambit permitted by a transverse pin 48 which engages a slot 50 (FIG. 4) in the ram. The rod 44 is slidably received in a bore 52 (FIGS. 5 and 5*a*) which extends into the base portion of ram 42 from a shoulder 54. The outer end of rod 44 carries a washer 56 (FIG. 4) and has a reduced diameter tip 58 which engages an appropriate recess in the top of the frame 46. A compression spring 60 surrounds rod 44 and is confined between shoulder 54 and washer 56. The spring 60 yieldably urges the rod 44 and frame 46 to a normal forward position on the ram as seen in FIGS. 2, 3 and 4. The forward end portion or blade 62 of the rame 42 is of particular advantageous configuration for seating wires in terminals such as the terminals shown in FIGS. 11 and 12, as will be referred to further below.

The frame 46 comprises a rear guide member 64, a front guide and cutter member 66, and side plates 68 and 70 which are joined to the two guide members by screws 72*a* –72*d*. The frame 46 encompasses ram bar 42 with a relatively close sliding fit. The inner surfaces of the members 64 and 66 slidably engage the rear an front surfaces 42*a* and 42*b* of the ram, while the inner surfaces of the plates similarly engage the respective side surfaces 42*c* and 42*d* of the ram. The rear guide member 64 is bifurcated at its distal end, includng two integral, spaced, guide fingers 78 and 80 defining a wire receiving slot 82 therebetween. Each of the fingers 78 and 80 is of a length to extend beyond the outer end of ram 42 even when the ram is in its fully extended position relative to the frame, as shown in dashed lines in FIG. 4. Finger 78 has a tapered inner surface 84 at its distal end portion and extends beyond finger 78 to serve as a guide in aligning the tool 20 with a connector 4 in jig 22. The shorter finger 80 is beveled at 85 on the slot side of its outer end and permits easy insertion of a wire into the slot 82.

A wire clamping member 86 in the form of a leaf spring is mounted on the plate 68. Member 86 includes an attachment spring leg 88, a cam section 90 and an L-shaped end section 92. The section 92 comprises a first portion 94 extending from cam section 90 over the side of the member 64, a flange portion 96 extending generally normal to portion 94 and overlying the rear surface of member 64, and a narrow clamping finger 98. Finger 98 is coplanar with portion 96 and extends along the rear surface of finger 80 at the side of slot 82. The clamping member 86 is secured to the frame by the screw 72*c* and includes an opening 100 which fits over the head of screw 72*d* to maintain alignment of the member with frame 46 while permitting lateral movement of the section 92 and particularly of clamping finger 98 between a retracted position as seen in FIG. 3 and a wire gripping position as seen in FIG. 3*a*. Such wire gripping or clamping movement is effected, against the retentive action of leaf spring section 88, by the cam action of a shoulder 104 on the ram 42 which engages the cam section 90 as the ram is advanced relative to frame 46 during a wire insertion operation.

A front guide member 66 includes a hook-shaped cutter portion 106 having shoulders 107 at its outer end. The cutter portion defined a partially closed or J-shaped inner surface 108 which serves to confine and guide a wire during a termination operation. The surface 108 also provides a fixed restraining edge against which a wire is sheared by the leading front corner 110 of the ram to trim a wire to the appropriate length as the ram is advanced in effecting a termination. The shoulders 107 are substantially coplanar with the bottom surface 112 of the guide slot 92 and are separated by a nub 114. The nub 114 is aligned with the blade portion 62 of the ram 42, i.e., is centered on the plane parallel to the longitudinal axis of the ram and which includes the center plane of the blade portion 62.

Referring to FIGS. 5 and 5*a*, the handle 36 of the tool 20 includes the aforementioned impact mechanism 40. The mechanism 40 is similar to a mechanism disclosed in the prevously mentioned U.S. Pat. No. 3,708,852 to Mason. The teachings of that patent are incorporated here by reference.

In outline, the mechanism 40 includes a slide 115 which is reciprocable axially of the handle 36. The slide 115 includes fork portion 116 which straddles the upper end porion of the ram 42 and is secured to the ram by a screw 117 through the fork legs and the ram. An anvil portion 118 extends upward from the bight section 116*a* of the fork and carries a guide pan 120 that extends into a hammer member 130. The pin 120 normally abuts a laterally sliding member 122 carried in the hammer 130. Member 122 has a hole 124 therein sufficient in diameter to accommodate entry of the pin 120 when these components are aligned with one another. However, at rest, as is shown in FIG. 5, the hole 124 is out of alignment with the pin 120 such that the pin 120 is precluded from moving further into the hammer. The nonalignment of the hole 124 with the pin 120 is maintained by a compression spring 126 which is contained in a chamber 127 in the hammer and urges the sliding member 122 toward a cam surface 128 on the handle housing. The surface 128 is inclined with respect to the axis of the handle 36, as shown.

The hammer 130 is maintained in the position shown in FIG. 5, at rest, by a compression spring 132 extending axially of the handle and around a rear portion 134 of the hammer 130. The spring 132 is confined between a shoulder 130*a* on the hammer and an adjustable stop member 135 which threadably engages an adjustment screw 136 having an annular flange 136*a* abutting a shoulder 137 of the handle housing. The spring 132 thus urges the hammer 130 downward toward shoulders 138 which also are part of the handle housing.

When compressive forces are applied to the handle 36 and the ram 42, along the longitudinal axis of the ram, the force on the ram is transmitted through the fork 116, anvil 118 and pin 120 of the slide to the laterally sliding member 122 in the hammer 130. In response to such a force of adequate magnitude, the ram 42, slide 115, sliding member 122 and the hammer 130 all are forced upward relative to the handle housing, thereby compressing the spring 132. During this relative telescopic movement, the laterally siding member 122 engages the cam surface 128 and is forced to the right as seen in FIG. 5 against the restoring force of the spring 126. Eventually, as the axial force exerted is increased and sufficient inward displacement of the anvil-hammer occurs, the laterally sliding member 122 is sufficiently displaced that the hole 124 comes into alignment with the pin 120. Consequently, the laterally sliding member 122 and the hammer 130 are permitted to move axially downward under the impetus of the energy theretofore stored in spring 132, to drive the hammer against a shoulder 140 of the anvil 118. This is best illustrated in FIG. 5*a* wherein the arrows 142 indicate the motion of the hammer 130 to engage the shoulder 140 which projects above shoulder 138 of the housing when the hole 124 in the sliding member 122 is aligned with the pin 118. At this point the energy previously accummulated in the compressed spring 132 is released, resulting in an impact discharge of energy against the anvil and, through the fork 116 and screw 177, to the ram 42.

The spring 132 has a spring constant substantialy greater than that of the spring 60. Thus, when axial compressive force is applied to the frame 46, the spring 60 compresses and no substantial inward movement of the ram 42 or concomitant deformation of the spring 132 occurs on account of the forces applied to the frame 46 until the pin 48 has reached the extreme inward limit of the slot 50. However, adequate forces applied directly to the ram 42 do result in inward movement of the ram 42 and concomitant deformation of the spring 132, as described.

A compression spring 144 surrounds the anvil 118. This spring engages, at one end, the bight portion 116*a* of the fork and, at the other end, shoulders 148 of the handle 36. Consequently, the spring 144 exerts a restoring force upon the slide 115 whenever the ram 42 is displaced inward in the handle 36, such that the ram assembly is restored to the extended position shown in FIG. 5 when all external forces are removed.

Referring now to FIGS. 6–8, the mounting jig 22 includes a base plate 150 which supports the wire clamp assembly 28 at one end and a rotatable carriage 154 for positioning and supporting a connector 24 near the opposite end. The clamp assembly 28 includes a generally semicylindrical hollow housing 156 which extends across the base plate 150 and is secured to the plate by screw 158. The center portion of the housing 156 is formed with a cable-receiving recess 160 extending longitudinally of the base 150 and defined by side walls 162 and 164. A thumb screw 166 is journaled in an end wall 168 of the housing and threadably engages a reciprocable clamping jaw element 170 which extends through wall 164. The element 170 includes an end surface 172 in opposition to wall 162. The head 174 of the thumbscrew 166 and a bushing 176 secured to its shaft 177 engage opposite sides of wall 168 to axially support the thumbscrew for reciprocating movement of the element 170 and for clamping a cable 26 between surface 172 and wall 162 upon suitable rotation of the thumbscrew.

The carriage 154 comprises a base portion 180 of generally circular configuration which is received in a circular recess 182 in the base plate 150. A machine screw 184 extends through opening 186 located centrally of the recess 182 and of the base portion 180 to retain the carriage 154 on the base 150 while permitting selective rotation of the carriage 154 about the axis of the screw 184. The head of the screw 184 and a spring washer 188 are received in a counterbore 190, with the washer being confined between the screw head and the shoulder of the counterbore as shown in FIG. 8. At its upper end, the screw 184 is threaded into and retains an elongated block or bar 192 which extends diametrically across the upper surface of the carriage base portion 180. The block 192 also engages an integral 194 which maintains the block in a predetermined alignment position on the carriage.

The carriage 154 is of a configuration to receive and hold a connector 24 in a pocket section 196 on the side of block or bar 192 remote from the wire clamp 28. This pocket section 196 of the carriage includes a raised floor portion 198 extending parallel to the block 192. A low rib 200 extends along the front edge of the floor 198 in parallel spaced relation to the bar 192, with upstanding posts 202 and 204 at each end. A taller rib 206 extends along the rear edge of the floor portion and merges with end supports 208 and 210 to form a shallow U-shaped rib as seen in plan in FIG. 6. The floor portion and the various ribs, posts and stops define a pocket or receptacle having surfaces of appropriate predetermined dimensions and spacing to receive a connector 24, preferably with a snug friction fit and to hold that connector in a precise predetermined position relative to the facing surface 212 of the bar 192, as will be referred to further below.

The carriage also includes a support section 214 extending from the connector support or pocket section 196. A cover 216 is journaled on pins 218 and 220 engaged in the support section. The cover is opened as in FIGS. 8 and 9 for inserting or removing a connector. recesses 222 in the side walls of the cover engage detents 224 to latch the cover closed over a connector in the pocket section 196 as in FIG. 1. The top of the cover may receive appropriate indicia, such as color coding plates, to guide the operator in locating appropriate wires in the various terminals.

A detent mechanism is included for holding the carriage 154 in any one of several preselected angular positions with respect to the base 150. Specifically, a ball 226, a compression spring 228 and a set screw 230 are received in a threaded bore 232 in the base 150. The ball is pressed by the spring into any one of several recesses 234 provided in the carriage base portion 180. The recesses 234 are suitably located around the outer circumference of the carriage base portion 180 in accordance with the various angular positions of the connector 24 relative to a cable 26 which may be desired when forming terminations.

A terminal of the type for which the above-described apparatus is adapted is shown in FIG. 11. As was mentioned, this terminal is fully described in the noted co-pending applications. However, a brief description of the terminal and the connector shown in part in FIG. 12 are included here for convenience. Specifically, a terminal 240 includes a contactor finger 241 and a trough or channel-like body section 242 defined by parallel sides 244*a* and 244*b* and a bottom or rear wall 245. Along the length of the trough 242, jaws 246*a* extend from the side 244*a* into the trough and opposing jaws 246*b* extend from the side 244*b* into the trough. The opposing pairs of jaws thus form narrowed areas in the trough. Opposing strain-relief tabs 248*a* and 248*b* extend from the upper edges of the respective sides angularly downward into the trough, over support dimples 249. Consequently, the cross-section of the trough 244 varies along its length. This configuration of the trough 244 is useful with respect to the solderless connection of wires therein. More specifically, the insulation of a wire forced laterally into the trough between the jaws 246, the a direction of movement transverse to the longitudinal axis of the wire, is torn or ruptured by the jaws, and electrical contact is established between the jaws 246 and the conductor core of the wire. In addition, the insulation of a wire forced between the tabs 248 is gripped by these tabs which then serve the function of a strain relief mechanism.

Referring to FIG. 12, several terminals 240 are assembled in a connector 24, e.g., fifty terminals in opposed rows for terminating 25 pairs of telephone wires. The connector 24 includes parallel-spaced ribs 252, some of which have been cut away in FIG. 12 for clarity of presentation. The ribs 252 include outer guide portions 254 and inner support portions 256 which abut the sides 242*a* and 242*b*. The abutment support portions 256 serve to support the sides of the terminals 240 to prevent spreading of the opposed sides and expansion of a trough 244 when a wire is forcibly inserted therein.

Referring particularly to FIGS. 1, 1*a*, 6, 8, 9*a* –9*c*, and 12, when a connector 24 is inserted in the pocket section 196 of the carriage 154, end flange surfaces 260 of the connector are in snug contact with the rear edge surfaces 262 of the posts 208 and 210, and end shoulder surfaces 264 on each end of the connector are in snug contact with the forward edge surfaces 266 on the posts 202 and 204. The surfaces 262 and 266 of the carriage thus establish the connector 24 in a precise predetermined spaced relationship with respect to the surface 212 of the block 192. In addition, the connector rigs 252 on the underside of the connector are in contact with the upper surface 270 of the rib 200, and the under surface 272 of the connector is in contact with the floor 198 of the carriage to support the connector.

The configuration of the blade portion 62 and the operation of the tool 20 are correlated to the configuration of terminal body sections 242 and the receiving recesses between ribs 252. The blade portion 62 is of a width to extend into each recess and into the respective terminal body portion 242 through its open side. A rearward portion of the blade is of reduced width in an area 62*a* to pass between the strain relief tabs 248 in an insertion operation. In addition, each blade includes notches 62*b* and 62*c* which are positioned to bridge and avoid contact with the terminal jaws 246. Between the notches is a pedestal 62*d* having a surface at its distal end substantially coplanar with the remainder of the end surface of the blade, and these end surfaces extend normal to the axis of the ram. Finally, the range of relative reciprocable movement permitted between the alignment and guide assembly 46 and the ram 62 is adequate to permit the ram to be advanced virtually to or actually against the rear wall 245 of a terminal in a connector 24, while the shoulders 107 are resting on ribs 252. Thus, a wire may be driven solidly against the rear wall 245, between jaws 246*b* and 246*b*, by force applied to the ram via the handle and impact mechanism, without that force being transmitted to the assembly 46 or to the connector, other then through the wire and the rear wall 245.

The operation of the apparatus herein disclosed should be apparent from the foregoing detailed description. However, a summary of the operation of the preferred tool 20 to insert one wire into a connector terminal 24 will be recounted with particular reference to FIGS. 1 and 9*a*–9*c*. The same operation may be employed to insert any number of wires individually into corresponding connector terminals.

A cable 26 with a group of freely extending individual wires 30 is clamped in the jig 22 and a connector is seated in the pocket 196 as in FIG. 1. The wires 30 are assumed to be of a length substantially greater than required to reach the connector terminals. The operator selects a wire 32 for insertion, normally holding the selected wire in one hand and the tool 20 in the other hand. The wire and tool are manipulated to straddle the wire with the fingers 78 and 80 to engage the wire in the open hook of cutter 106, generally as shown in FIGS. 2 and 4. While preferably maintaining slight tension on the engaged wire by hand, as by pulling outward and downwardly into the hook 106, the finger 78 is inserted between the surface 121 and the outer end of the connector 24 as in FIGS. 1 and 9*a*, and the tool is laterally aligned over the space between two ribs 252 corresponding to the selected terminal 240. The width of finger 78 is substantially equal to the width of the space between the connector and the bar 92, and the tapered narrowed end 84 of the finger 78 facilitates its entry between these elements. The nub 114 is placed between the respective ribs 252 to insure the lateral alignment of the ram and wire with the selected recess and terminal, and the shoulders 107 are in contact with the ribs 252 when the tool is fully positioned as shown in FIGS. 1 and 9*a*. The forward surface of the fingers 78 and 80 engages the adjacent end of the connector, which aligns the tool 20 along the major axis of the terminal 240. Therefore, the wire and the tool blade 62 are fully registered with the terminal. Moreover, positioning of the guide fingers against the connector is assured in that the rear surface of the finger 78, which is arranged a predetermined distance from the rear of the blade 62, abuts the alignment surface 212 of the alignment block 192. If wires 32′ already are terminated in the opposite bank of terminals as in FIGS. 9*a*–9*c*, the guide finger 78 passes betweeh these wires 32′ as shown.

Since shoulders 107 and the inner surface 112 of the slot 82 are substantially coplanar, the wire 32 is placed below the upper surface of the ribs 252 by surface 112 when the tool is positioned as described, even though the ram 42, and specifically the blade 62, is as yet unextended relative to the frame 46. Thus, entry of the wire 32 into the trough between the respective ribs 252 of the connector is initiated as in FIGS. 9*a* before the ram is advanced to drive the wire.

Downward force then is applied to handle 36, thereby extending the ram 42 through the frame 46 which remains in the registered position on the connector. During the initial relative movement of the ram, the clamping member 86 is driven into gripping engagement with the wire, as in FIGS. 3*a* and 9*b*. Additional downward movement of the ram 42 with respect to the frame 46, past the position of FIG. 9*b*, results in shearing of the wire 32 between surface 108 and edge 110, thus trimming the wire to the appropriate length for insertion into the respective terminal 240. This frees the end of the wire being hand-held. However, the clamping engagement by member 86 assures retention of the trimmed wire 32 in the proper axial position as the wire is translated into the terminal portion 242 by the ram for effecting the termination. Lateral positioning of the wire in alignment with the end surface of the ram and with the terminal 240, which initially was effected by the fingers 78;14 80 and guide 106, is maintained and assured during the translational drive phase by the fact that the wire already is entered between the ribs 252.

As the ram 42 is extended into the terminal body, to the seated position of FIG. 9*c*, the wire 32 is forced against the bottom 245 of the terminal. The close fit and capture of guide finger 78 between the outer end of the connector 24 and the surface 212 helps assure that the operator will position the hand tool with its longitudinal axis normal to the terminal and thus with the distal end surface of the blade 62 parallel to the respective rear wall 245 for reliable complete seating of the wire in the terminal body. Providing the tool with a dimension from the front of guide 106 to the front of guide 64 equal to the length of the connector ribs will result in guide 106 abutting the rear recess wall and the shoulder of the connector as in FIG. 9*c*, which can provide alternative or redundant assistance in obtaining this proper seating orientation of the tool relative to the connector. The jaws 246 rupture the insulation in the seating process, and the wire conductor is placed in electrical contact with the terminal 240 through the contact jaws. The strain relief tabs 248 engage in gripping contact with the wire insulation to prevent removal of the wire from the terminal. As the wire is driven into the terminal, it is slid off of the gripper finger 98, but is thereupon held by the terminal.

It should be noted here that the notches 62*b* and 62*c* in the blade 62 are in alignment with the contact jaws 246 of the terminal 240. In addition, the area 62*a* of reduced cross section in the blade 62 is in alignment with the strain relief tabs 248 of the terminal. Thus, extension of the ram 42 results in no damage or deleterious effects to the terminals 240, either to the electrical contact jaws 246 or to the strain relief tabs 248.

As the ram reaches the bottoming position for the wire, the mechanism 40 trips and delivers an impact blow to ensure proper seating and electrical contact of the wire in the terminal. Other means may be provided to insure that proper seating forces are provided. It has been found that a seating force of at least 35 pounds is required with terminals 240, and a trigger-type impact tool, e.g., set to deliver about a 45 pound impact, conveniently insures that this force level will be reached or exceeded for each termination. It should be noted that the pin 18 is not against the end surface of the slot 50 when the wire 32 is seated. Thus, the impact discharge of energy as above described is transmitted through the ram directly to the wire 32.

Another insertion tool which includes some of the features of tool 20 and which may be used with connectors similar to connectors 24 and with jig 22 is shown in FIGS. 10*a* and 10*b* as the tool 300. Tool 300 includes a handle 302 which houses an impact mechanism similar to the mechanism 40. A ram 304 projects forwardly from the impact mechanism and handle, generally axially of the handle. The ram 304 includes a portion 306 of reduced diameter connected to a blade and guide head 310. The blade and guide head 310 includes a blade portion 312 having an end surface normal to the axis of the ram for use in pushing a wire laterally into a terminal of the type described above. To this end, the blade portion is of a configuration similar to blade 62, including an area 312*a* of reduced width, and notches 312*b* and c, for mating with a connector 240. In addition, the head 310 includes a bifurcated guide 314 at its distal end which extends beyond the aforementioned blade 312, at the rear edge of the blade. The guide includes two integral spaced fingers 316 defining a wire receiving slot 318 therebetween.

A guide frame 324 is slidably mounted on the ram for relative reciprocating movement along the ram within the ambit permitted by a transverse pin 325 which is mounted in the ram head and engages a slot 326 in the guide frame. A compression spring 328 surrounds the ram portion 306 between a shoulder 304*a* and a mounting flange 329 of the guide frame 324. The spring 328 urges the guide frame 324 to a normal forward rest position as shown in FIG. 10*a*. The guide frame 324 includes fingers 330 and 332 which project from the body of the guide frame beyond the insertion blade 312 when the guide frame 324 is in the position of FIG. 10*a*. The fingers 330 and 332 are aligned along the axis of the ram 304 and on opposing sides of the blade 312, at the forward portion of the blade, for receiving and guiding a wire in alignment with the blade end surface. These fingers engage a pair of adjacent ribs 252 when the tool 300 is manipulated to align the ram and an aligned wire with an intervening termination recess. During subsequent advancement of the ram to drive the aligned wire into a terminal body 242 in the straddled recess, the guide 324 rests atop the respective ribs 252. The relative movement of these components to the relative position shown in FIG. 10*b* is accommodated by compression of spring 328.

The tool 300 may be used as shown if trimming of the wires during insertion is unnecessary. Alternatively, additional means may be provided for trimming a wire prior to or during insertion into a terminal, e.g., by providing another element with a shearing edge in cooperative shearing relative to edge 312*d*. If each wire is to be trimmed prior to engagement in the terminal, a wire gripper mechanism preferably is added as in tool 20. As another alternative, a chisel-type cutter may be added beneath the corner 312*d* for trimming the wires after seating if the terminals and connectors are of appropriate design to permit and withstand such a severing operation.

It will be obvious that other modifications of the specific embodiments shown may be made without departing from the spirit and scope of the invention.

It will be seen that improved wire termination apparatus has been provided which meets the objects of the invention.

While particular embodiments of this invention have been shown, it will be understood, of course, that the invention is not limited thereto since modifications may be made by those skilled in the art, particularly in light of the foregoing teachings. Therefore, it is contemplated by the appended claims to cover any such modifications as incorporate those features which may be said to constitute the essential features of these improvements within the true spirit and scope of the invention.

What is claimed is:

1. Apparatus for effecting solderless termination of an insulated electrical conductor wire in a connector including an elongated trough-shaped terminal including a rear wall and opposed side walls and having an open side opposite such rear wall and means in said trough-shaped terminal and adjacent such rear wall for rupturing the insulation of an insulated wire forced thereagainst through said open side and effecting electrically conductive contact with the conductor thereof, comprising insertion means for inserting a wire into such terminal through such open side, said insertion means comprising a ram including an end portion of a thickness and configuration to enter such trough-shaped terminal through such open side, said end portion terminating in an end surface for contacting and applying force to a portion of such a wire in a direction perpendicular to the longitudinal axis of such wire, said ram end portion being movable into such terminal to a position in which said end surface applying force to such a wire is generally parallel to such rear wall and spaced therefrom a distance less than the normal diameter of such a wire, and driving means operatively connected with said ram for driving said ram end portion and such a wire in contact with such end surface laterally into such terminal to such a position for compressing said wire against such rear wall, thereby ensuring conductive engagement with such electrical contact means.

2. Apparatus as in claim 1 wherein said end surface of said ram is substantially planar and no part of said end portion projects beyond the plane of said end surface.

3. Apparatus as in claim 1 wherein such means for rupturing insulation comprises protrusions into the trough of such elongated terminal, said end portion comprising a plurality of segments having end surfaces which are substantially coplanar with one another, said segments being positioned to straddle such protrusions when said ram is so moved into such terminal.

4. Apparatus as in claim 3 wherein such means for rupturing insulation comprises a plurality of protrusions extending inward from each of such side walls of such terminal, and said end portion being formed with notches separating said segments and located to register with such protrusions when said end portion is driven into such terminal.

5. Apparatus as in claim 4 wherein such elongated troughshaped terminal further comprises a pair of mutually opposing spaced strain relief protrusions extending inward from such side walls, and said end portion including a segment of reduced cross-section to pass between such strain relief protrusions when said ram is so moved into such terminal.

6. Apparatus as in claim 1 further comprising means for trimming a wire at one end of said end surface before said driving means drives said ram and said wire into said terminal, and gripping means for gripping said wire adjacent said end surface to prevent axial movement of the trimmed wire relative to said surface as such wire is inserted in said terminal.

7. Apparatus as in claim 6 wherein said gripping means comprises means for applying an axial retention force to said wire while permitting movement of said wire perpendicular to its axis into said terminal.

8. Apparatus as in claim 6 further comprising alignment means including a finger positioned at said other end of said end surface and wherein said gripping means includes a gripping arm spaced from said finger and movable toward said finger for gripping a wire between said arm and said finger.

9. Apparatus for effecting solderless terminations of insulated electrical conductor wires in a connector having a plurality of elongated trough-shaped recesses each including a rear wall and opposed side walls and having an open side opposite such rear wall and terminal means in each of such recesses for rupturing the insulation of an insulated wire forced thereagainst through such open side and effecting electrically conductive contact with the conductor thereof, comprising insertion means for inserting individual wires into each of such recesses through such open side, said insertion means comprising a ram including an end portion of a thickness and configuration to enter each of such recesses through the respective open side, said ram end portion being selectively movable into such recesses, said end portion terminating in an end surface for applying force to a portion of a wire in a direction perpendicular to the longitudinal axis of such wire, alignment means supported on said ram adjacent said end surface for aligning such a wire with said ram end surface and being engageable with such connector for aligning said ram end portion and aligned wire over each of such open sides in registry with each of such recesses, and driving means operatively connected to said ram for driving said ram and such an aligned wire laterally into one of such recesses and thereby forcing such a wire into electrically conductive engagement with the respective terminal means therein.

10. Apparatus as in claim 9 wherein said alignment means comprises a pair of spaced fingers positioned at one end of said end surface.

11. Apparatus as in claim 9 wherein said alignment means comprises means positioned at one end of said end surface for placing such a wire at least partially within the respective recess before said driving means drives said ram against said wire.

12. Apparatus as in claim 9 further comprising means positioned at one end of said end surface for trimming said wire before said driving means drives said ram into such a recess and gripping means for gripping said wire adjacent the other end of said surface to restrain axial movement thereof while permitting movement of said wire in a predetermined direction perpendicular to its axis.

13. Apparatus for effecting solderless terminations of insulated conductor wires in a connector having a plurality of elongated trough-shaped recesses each including a rear wall and opposed side walls and having an open side opposite said rear wall, with terminal means in each of said recesses for rupturing the insulation of such a wire when said wire is forced into said recess through said open side and effecting electrically conductive contact with the conductor thereof, comprising a movable ram for forcing a wire laterally into said terminal means in each of said recesses through said open side, said ram including an end portion of a thickness and configuration to enter each of said recesses through the open side thereof, alignment means for aligning individual wires with said ram and for aligning said ram with a selected one of said recesses in such a connector, driving means for driving said ram end portion and such an aligned wire into said terminal means, and said alignment means including positioning means for positioning such a wire at least partially in the respective recess when said ram and wire are aligned therewith and before said driving means drives said ram against said wire.

14. Apparatus for effecting solderless terminations of insulated conductor wires in a connector having a plurality of elongated troughshaped recesses each including a rear wall and opposed side walls and having an open side opposite such rear wall, with terminal means in each of such recesses for rupturing the insulation of such a wire when such wire is forced into such recess through such open side and effecting electrically conductive contact with the conductor thereof, comprising a movable ram for forcing a wire laterally into such terminal means in each of such recesses through such open side, said ram including an end portion of a thickness and configuration to enter each of such recesses through the open side thereof, said ram end portion defining an insertion surface having major and minor transverse axes, alignment means for aligning individual wires with said ram and for aligning said ram with a selected one of such recesses in such a connector, said alignment means comprising a guide frame operatively connected to said ram and slidable therealong, said guide frame including guide means for substantially aligning such a wire with said major axis of said insertion surface and for holding portions of such an aligned wire at a predetermined distance from said insertion surface when said guide frame is in an extended position relative to said ram, and driving means for driving said ram end portion and such an aligned wire into such terminal means, said alignment means including positioning means for positioning such a wire at least partially in the respective recess when said ram and wire are aligned therewith and before said driving means moves said ram into such recess.

15. Apparatus as in claim 14 wherein said guide means comprises a pair of fingers in spaced relationship to one another and positioned at one end of said insertion surface, and an abutment surface between said fingers substantially parallel to said insertion surface and at a predetermined distance outward from said insertion surface when said frame is in said extended position relative to said ram.

16. Apparatus for inserting a wire into a terminal having means to retain an end portion of a wire therein, comprising first means for moving such an end portion of a wire laterally of the longitudinal axis of such wire into engagement with such wire retention means of such a terminal, means for aligning an untrimmed wire with said first means in position for such movement into engagement with such retention means by said first means, severing means for trimming such an aligned wire at one side of said first means prior to engagement of such wire with such retention means by said first means, thereby providing an end portion of such wire of a predetermined length in registry with such first means for insertion into said terminal, and means for gripping said wire adjacent said first means during the movement of such end portion into such terminal and into engagement with such retention means by said first means to avoid axial movement of such end portion after trimming by said severing means.

17. Apparatus as in claim 16 including means for actuating said gripping means to grip such a wire prior to trimming thereof by said severing means.

18. Apparatus as in claim 16 including means for actuating said gripping means into gripping engagement with such a wire in response to advancing movement of said first means.

19. Apparatus as in claim 18 wherein said first means comprises a reciprocable ram and said severing means comprises an edge of said ram at said first side thereof and a shear member adjacent said edge.

20. Apparatus as in claim 16 wherein said aligning means includes a finger positioned at the opposite side of said first means and said gripping means includes a gripping arm spaced from said finger and movable toward said finger for gripping a wire between said arm and said finger.

21. Apparatus for inserting a wire into a terminal in a recess in a connector wherein such recess and terminal are open at one side of such connector to receive a wire in such terminal by movement of the wire generally laterally of the longitudinal axis of the wire into such terminal through such side and such recess and terminals are open at one end whereby the wire protrudes through such open end after being received in such terminal, comprising a ram member having an end portion for insertion into such a terminal through such open side to press a wire into such terminal transversely of the axis of such a wire, a guide connected to said ram, said guide being positioned along one edge of said end portion and projecting therebeyond for engaging such one end of such connector to position said ram along such open side of such recess and terminal, means for aligning a wire with the distal end of said end portion, and guide means at the edge of said end portion opposite said guide for engaging such a connector in alignment with such a recess to assist in aligning such a wire and said ram with each such recess and terminal.

22. Apparatus as in claim 21 including first and second mutually spaced fingers positioned along said one edge of said end portion and disposed to maintain a wire therebetween in alignment with said distal end surface, at least one of said fingers extending beyond said end portion for so engaging such one end of such a connector.

23. Apparatus as in claim 22 wherein said fingers are supported on said ram for reciprocation movement along said ram, and means resiliently urging said fingers to an extended position relative to said end portion.

24. Apparatus as in claim 23 including an abutment surface between said fingers and movable with said fingers, said abutment surface being disposed outward of the distal end of said end portion when said fingers and abutment surface are in such extended position.

25. Apparatus as in claim 21 wherein said guide means is supported on said ram for relative reciprocation movement along said end portion.

26. Apparatus as in claim 25 wherein said guide means includes a wire-guide portion disposed to maintain a wire in alignment with the distal end surface of said end portion.

27. Apparatus as in claim 21 including a finger positioned along said one edge of said end portion and protruding therebeyond, and a gripping arm spaced from said finger and movable toward said finger for gripping a wire between said arm and said finger when such wire is aligned with said distal end surface.

28. Apparatus as in claim 27 including a resiliently movable gripper member, said gripping arm being a part of said member, said finger and said arm being supported on said ram for reciprocation movement along said ram, and cooperative cam means on said ram and said member for moving said gripping arm toward said finger as said ram is advanced relative to said finger and said member.

29. Apparatus as in claim 21 including a frame mounted on said ram for reciprocating movement therealong, means resiliently urging said frame to an axially outward position relative to said ram, said frame including first and second mutually spaced fingers positioned along one edge of said end portion and a member having a partially closed wire-guide surface positioned along an opposite edge of said end portion, said fingers and said member extending beyond the distal end surface of said end portion when said frame is in its extending position relative to said ram and being disposed to maintain a wire engaged thereby in alignment with said distal end surface, at least one of said fingers extending beyond said distal end surface when said ram is advanced relative to said frame for engaging said one end of such a connector, and said guide means comprising a protuberance on the distal end of said member disposed for engaging in such a recess.

30. Apparatus as in claim 29 wherein said member and said ram are positioned to cooperate for shearing such an aligned wire therebetween as said ram is advanced relative to said frame, a movable gripper arm adjacent one of said fingers and movable toward the other of said fingers, and means actuated as said ram is so advanced for moving said gripper arm toward said other finger for gripping such an aligned wire between said arm and said other finger.

31. Apparatus as in claim 29 including an abutment surface between said fingers and movable with said fingers, said abutment surface being disposed outward of the distal end of said end portion when said ram is retracted relative to said frame.

32. Apparatus as in claim 29 further comprising a handle reciprocably attached to said ram at the end opposite said end portion, and energy accumulation means in said handle, sid accumulation means being actuated by movement of said ram into said handle for applying an impact discharge of energy to said ram upon movement of said ram a predetermined distance into said handle to assist in seating a wire in such a terminal.

33. Apparatus as in claim 21 further comprising a jig for mounting a connector which includes a series of such terminals in alignment with one another, said jig including an alignment surface positioned to extend perpendicular to the major axis of such terminals and at a predetermined distance from such terminals of a connector mounted in said jig, said guide cooperating with said alignment surface to register said ram end portion with such terminals of a connector when so mounted in said jig.

* * * * *

UNITED STATES PATENT AND TRADEMARK OFFICE

CERTIFICATE OF CORRECTION

PATENT NO. : 3,997,956

DATED : December 21, 1976

INVENTOR(S) : William H. McKee

It is certified that error appears in the above-identified patent and that said Letters Patent are hereby corrected as shown below:

| | |
|---|---|
| Col. 1, line 5 | Delete "to" (second occurrence), insert --for-- |
| Col. 1, line 58 | "amounting" should be --a mounting-- |
| Col. 1, line 65 | "position" should be --positions-- |
| Col. 2, line 57 | "rame" should be --ram-- |
| Col. 2, line 66 | "an" should be --and-- |
| Col. 3, line 11 | "4" should be --24-- |
| Col. 3, line 38 | "defined" should be --defines-- |
| Col. 3, line 46 | "92" should be --82-- |
| Col. 3, line 54 | "prevously" should be --previously-- |
| Col. 3, line 60 | "porion" should be --portion-- |
| Col. 4, line 29 | "siding" should be --sliding-- |
| Col. 4, line 46 | "accummulated" should be --accumulated-- |
| Col. 4, line 49 | "177" should be --117-- |
| Col. 5, line 38 | After "integral" insert --rib-- |
| Col. 5, line 63 | "recesses" should be --Recesses-- |
| Col. 6, line 34 | Delete "the" (second occurrence), insert --in-- |

UNITED STATES PATENT AND TRADEMARK OFFICE

CERTIFICATE OF CORRECTION

PATENT NO. : 3,997,956

DATED : December 21, 1976

INVENTOR(S) : William H. McKee

It is certified that error appears in the above-identified patent and that said Letters Patent are hereby corrected as shown below:

| | |
|---|---|
| Col. 6, line 64 | "rigs" should be --ribs-- |
| Col. 7, line 22 | "246b" (first occurrence) should be --246a-- |
| Col. 7, line 25 | "then" should be --than-- |
| Col. 7, line 43 | Before "to" insert --and-- |
| Col. 7, line 48 | "121" should be --212-- |
| Col. 8, line 3 | "betweeh" should be --between-- |
| Col. 8, line 33 | "78;1480" should be --78-80-- |
| Col. 9, line 66 | "relative" should be --relation-- |
| Col.11, line 2, | "troughshaped" should be -- trough-shaped --. |
| Col.12, line 26, | "troughshaped" should be -- trough-shaped --. |
| Col.14, line 53, | "sid" should be -- said --. |

Signed and Sealed this

Seventh Day of June 1977

[SEAL]

*Attest:*

RUTH C. MASON
*Attesting Officer*

C. MARSHALL DANN
*Commissioner of Patents and Trademarks*